US011612995B2

(12) United States Patent
Demko

(10) Patent No.: US 11,612,995 B2
(45) Date of Patent: Mar. 28, 2023

(54) AXE HEAD ATTACHMENT

(71) Applicant: Cold Steel, Inc., Ventura, CA (US)

(72) Inventor: Andrew Demko, Wampum, PA (US)

(73) Assignee: GOOD SPORTSMAN MARKETING, LLC, Irving, TX (US)

( * ) Notice: Subject to any disclaimer, the term of this patent is extended or adjusted under 35 U.S.C. 154(b) by 0 days.

(21) Appl. No.: 16/798,384

(22) Filed: Feb. 23, 2020

(65) Prior Publication Data

US 2021/0197359 A1 Jul. 1, 2021

Related U.S. Application Data

(60) Provisional application No. 62/955,784, filed on Dec. 31, 2019.

(51) Int. Cl.
*B25G 3/24* (2006.01)
*B26B 23/00* (2006.01)

(52) U.S. Cl.
CPC ..... *B25G 3/24* (2013.01); *B26B 23/00* (2013.01)

(58) Field of Classification Search
CPC ..... B26B 23/00; B26B 13/04; B26B 13/28; B25G 3/28; B25G 3/24; B25D 7/00; B25D 1/00
USPC ..... 30/308.1–308.3, 125; 7/145; D8/76; 411/104, 166
See application file for complete search history.

(56) References Cited

U.S. PATENT DOCUMENTS 96,837 A * 11/1869 Quast ..... B26B 23/00 30/308.3
287,795 A * 11/1883 Blighton ..... F16B 33/002 411/177
308,934 A 12/1884 Trenor
588,072 A * 8/1897 Latimer ..... B26B 23/00 30/308.3
597,451 A 1/1898 Zeckendorf
670,790 A * 3/1901 Leffingwell ..... F16D 1/0894 30/308.3
759,733 A * 5/1904 De Haven ..... B26B 23/00 30/308.3
812,067 A * 2/1906 De Haven ..... B26B 23/00 30/308.3
937,911 A * 10/1909 Amster ..... F16B 2/065 403/344

(Continued)

FOREIGN PATENT DOCUMENTS

DE 29902369 7/1999
GB 340854 1/1931
WO WO-2012151745 A1 * 11/2012 ..... B26B 23/00

*Primary Examiner* — Laura M Lee
(74) *Attorney, Agent, or Firm* — William F. Lang, IV; Lang Patent Law LLC

(57) ABSTRACT

An axe head is attached to a handle in a manner that utilizes the inertia of the axe head to bear against a structure that resists separation of the axe head from the handle. In one example, that structure is a key that fits within the handle after the axe head is slid onto the handle, resisting passage of the axe head past the key. In another example, at least one end piece is joined to a narrowed, toothed section of the handle, forming an assembly with a friction fitted portion and an end portion with a diameter that exceeds the diameter of the hole in the axe head, retaining the axe head on the friction fitted portion of the handle assembly.

4 Claims, 12 Drawing Sheets

(56) References Cited

U.S. PATENT DOCUMENTS

| | | | | | |
|---|---|---|---|---|---|
| 1,030,429 | A | * | 6/1912 | Reeves | G03D 15/043 403/393 |
| 1,054,929 | A | | 3/1913 | Melluish et al. | |
| 1,339,357 | A | * | 5/1920 | Kopriva | B26B 23/00 30/308.3 |
| 1,886,272 | A | * | 11/1932 | Thomson | B25B 7/08 403/38 |
| 2,917,349 | A | * | 12/1959 | Saylor | F16B 11/006 81/22 |
| 3,856,341 | A | * | 12/1974 | Florek | A01D 87/12 294/24 |
| 4,347,883 | A | | 9/1982 | Fariss, Jr. | |
| 4,412,572 | A | | 11/1983 | Clark | |
| 5,152,065 | A | | 10/1992 | Harding | |
| 5,255,575 | A | * | 10/1993 | Williams | B25F 1/02 81/26 |

* cited by examiner

AXE HEAD ATTACHMENT

CROSS REFERENCE TO RELATED APPLICATION

This application claims the benefit of U.S. provisional patent application Ser. No. 62/955,784, which was filed on Dec. 31, 2019, and entitled "Axe Head Attachment."

TECHNICAL FIELD

The present invention relates to axes, hatchets, and tomahawks. More specifically, an improved attachment between the cutting head of the axe, hatchet, or tomahawk and the handle is provided.

BACKGROUND INFORMATION

Various types of axes, hatchets, and tomahawks (collectively referred to herein as axes) are used for a variety of purposes. They are commonly used to cut wood for use in a fireplace or for other purposes. They are sometimes used in throwing competitions. They have also historically been used as weapons. These types of cutting instruments typically include a heavy cutting head on one end of a handle, with the other end of the handle being grasped by the user. Due to the weight of the cutting head, as well as the inertia developed during a swing, it is critical that the head remain attached to the handle.

Traditionally, Tomahawk handles were made so that the end grasped by the user is narrower than the end retaining the cutting head. The cutting head defines a hole therethrough for receiving the handle. The cutting head is slid from the grasping end of the handle to the handle retaining portion, with the shape of the handle resisting the head from sliding off the opposite end of the handle. Although effective for retaining the head, this design carries the disadvantage of limiting the shape of the handle. Therefore, various means of retaining an Axe head that is slid onto the handle from the ended which it is retained have been proposed.

An example of a previously proposed design is GB 340,854, which discloses an improved axe head. The axe includes a slot extending from the butt to the eye. A bolt passes through a hole drilled on either side of slot, with one side being threaded. The axe head can be removed by removing the bolt, and then using a wedge to open the slot.

U.S. Pat. No. 670,790 discloses a camper's axe or tool. The handle is tapered so that the narrowest part of the taper is the end of the handle that is inserted into the eye of the axe head. The exit includes a hole for receiving a screw, one side of which is threaded. A notch is cut into the handle to receive the screw. A notch is described as being preferable to a hole because it could be cut into an improvised handle with a pocketknife. The screw is tapered to draw the outer face of the notch of the handle into the eye, holding it firmly in place.

U.S. Pat. No. 1,054,929 discloses an axe. The axe includes a head having a detachable bit. The detachable bit includes a shank that fits into a bifurcated end of the head. A felt strip is located between the shank and the inner walls of the bifurcation, extending into the eye containing the handle. A pair of screws pass through the shank and the walls of the bifurcation. The screws are received by a pair of square bolt casings having tapered walls. The bolt casings are received within correspondingly shaped recesses within the head.

DE 29902369 discloses a hand tool such as a hammer or axe. One embodiment includes a head having two parts that are secured together by screws to clamp the handle therebetween. The handle includes a hollowed out portion where it interfaces with the head, thus preventing the head from sliding off the handle. Another example is illustrated in FIG. 5. In this embodiment, the head is one piece, and includes a slot having a width that can be changed by a tightening screw.

U.S. Pat. No. 308,934 discloses a tool handle. The tool handle includes a pair of opposing edges that are tapered so that they widen towards the end of the handle, so that this wider portion retains the axe head on top of the handle.

U.S. Pat. No. 588,072 discloses an axe. The axe includes a head with a separate blade. The head includes a slit, as well as an eye that is provided with transverse corrugations. The blade includes a shank that fits into a recess defined adjacent to the slut. A screw passes through the sides of the recess as well as the shank of the blade, clamping the sides of the head around the axe handle and the blade.

U.S. Pat. No. 597,451 discloses a tool handle and device for securing same. The handle includes a slot terminating in a socket. A locking wedge fits within the socket. The axe head includes openings corresponding to the socket. After the locking wedge is placed in the socket, and the axe head placed on the handle, a pair of keys are placed within the socket, holding the locking wedge and axe head on the handle.

U.S. Pat. No. 1,339,357 discloses an axe with a head having a removable bit. The head includes a vertically extending groove having jaws on either side. The back end of the bit includes a narrowed portion to fit between the jaws. Holes within the jaws are aligned with elongated holes within the back end of the bit. Tapered pins are driven through these holes, drawing the bit firmly into the head. Another pair of pins pass through the jaws at the back end of the bit, engaging a pair of holes defined along the back edge of the bit. Another hole is provided to permit driving a wedge therethrough in order to remove the bit.

U.S. Pat. No. 4,347,883 discloses an easily removable axe handle. The handle includes a slot at one end. The axe head is slid over this slot. A hole in the back of the axe head permits a screw to be inserted through this hole and into the slot in the handle. The diameter of the screw threads is sufficient to expand the slot as the screw is turned, thus securing the head to the handle.

U.S. Pat. No. 4,412,572 discloses a splitting axe. The axe head is retained on the handle by a retaining pin passing through both the handle and the head. The retaining pin is located in a position that is remote from the center of gravity of the head, which is also within the eye.

U.S. Pat. No. 5,152,065 discloses a tool head having an easily replaceable handle. The tool head includes a main body and a detachable side plate that is held in place by bolts or screws. A channel is defined between the main body and the side plate for receiving the handle. The handle contacting surfaces of the head includes a plurality of sharpened protrusions, teeth, or ridges extending outwardly therefrom.

As the above examples illustrate, many previous designs utilize a screw or threaded bolt to clamp and ask head around the handle. As with any threaded fastener, the potential exists for the fastener to come loose, risking detachment of the axe head from the handle. Accordingly, there is a need for an axe head attachment that permits the axe head to slide over the non-grasping end of the handle, but which also relies on the inertia of the axe head during a swing to aid in retaining the accent on the handle. Such an attachment method would not only combine simple attachment and replacement of the Axe said or handle, but would also provide maximized flexibility in handle design as well as additional resistance to detachment of the accident from the handle.

SUMMARY

The above needs are met by an axe comprising a head having an opening therethrough. The opening extends from a top surface to a bottom surface. The opening has a wall defining a channel therein, with the channel extending from an intermediate portion of the opening to the top surface of the opening. The channel has a width. The axe further has a handle having a head attachment portion fitting within the opening. The head attachment portion has a hole therein, the hole has a width or a diameter that is substantially identical to the width of the channel, as well as a depth. The axe further includes a key having a length that is greater than the depth of the hole. The key further has a width or a diameter that is substantially identical to the width or diameter of the hole.

The above needs are further met by an axe comprising a head having a body including a cutting edge and a pair of flanges extending opposite the cutting edge. The head has an opening passing between the flanges, with the opening extending from a top surface to a bottom surface. Each of the flanges defines at least one fastener hole disposed opposite the body. The axe further includes a handle having a head attachment portion fitting within the opening. The axe also includes a clamping fastener passing through the fastener holes. The clamping fastener includes a nut having a convex curved surface abutting a corresponding concave curved surface defined on one flange, and a threaded fastener passing through the fastener hole of the other flange and engaging corresponding threads defined within the nut.

The above needs are alternatively met by an axe comprising a head having an opening therethrough, with the opening extending from a top surface to a bottom surface. The opening has a width. The axe further includes a handle assembly having a shaft and at least one end piece. The shaft has a head attachment portion defined proximate to one end. The handle attachment portion has a width that is less than the width of the opening of the head. The handle attachment portion and end piece each define an interlocking surface that interlocks with the other interlocking surface. The end piece defines an intermediate portion fitting within the opening with a friction fit when joined to the shaft, and an end portion that is larger than the opening in the head when joined to the shaft.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 2:
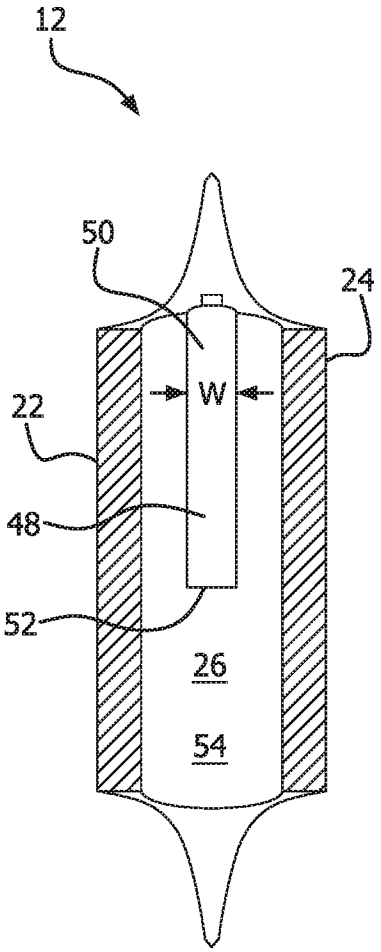
FIG. 2 is a cutaway back elevational view of the axe head of FIG. 1, taken along the line A-A in FIG. 1.

Referring to the drawings, two different accent attachments are shown. A first attachment is illustrated in FIGS. 1-8, and the second attachment is illustrated in FIGS. 9-15.

Figure 1:
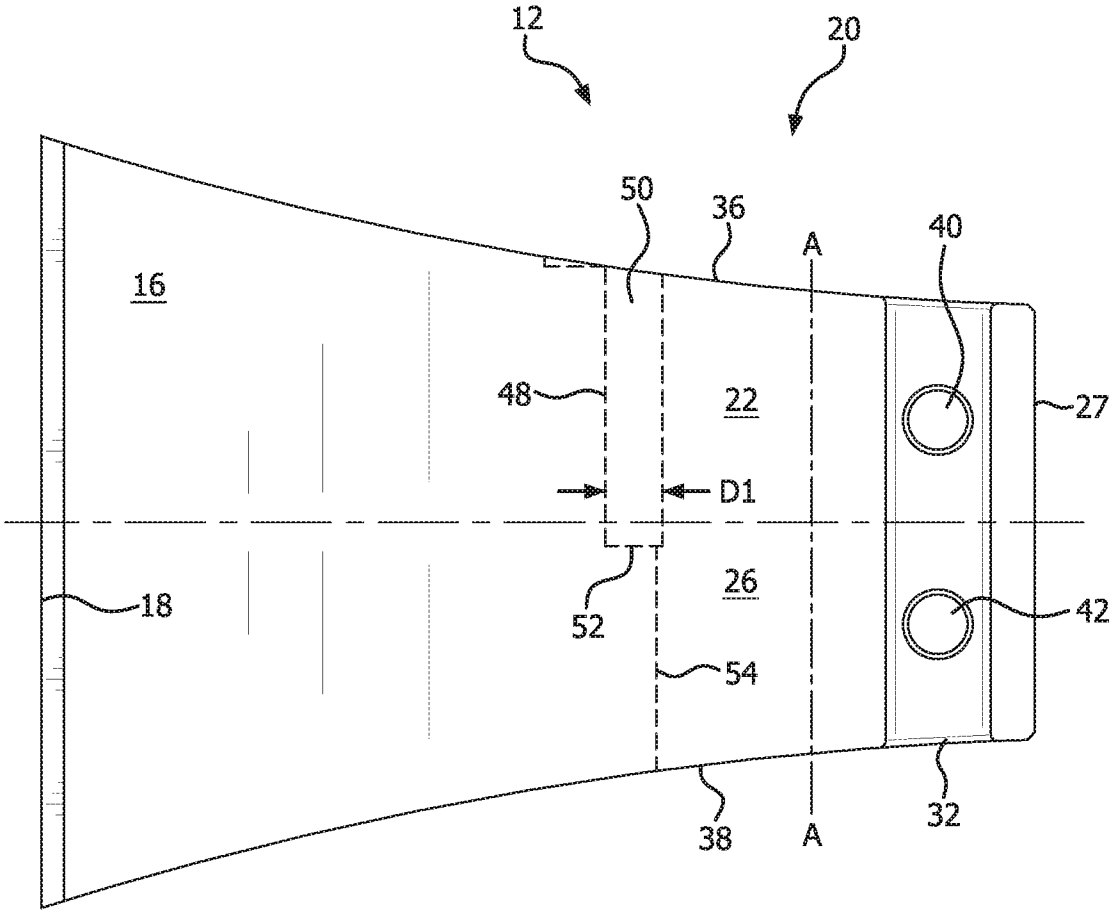
FIG. 1 is a side elevational view of an axe head.
Figure 3:
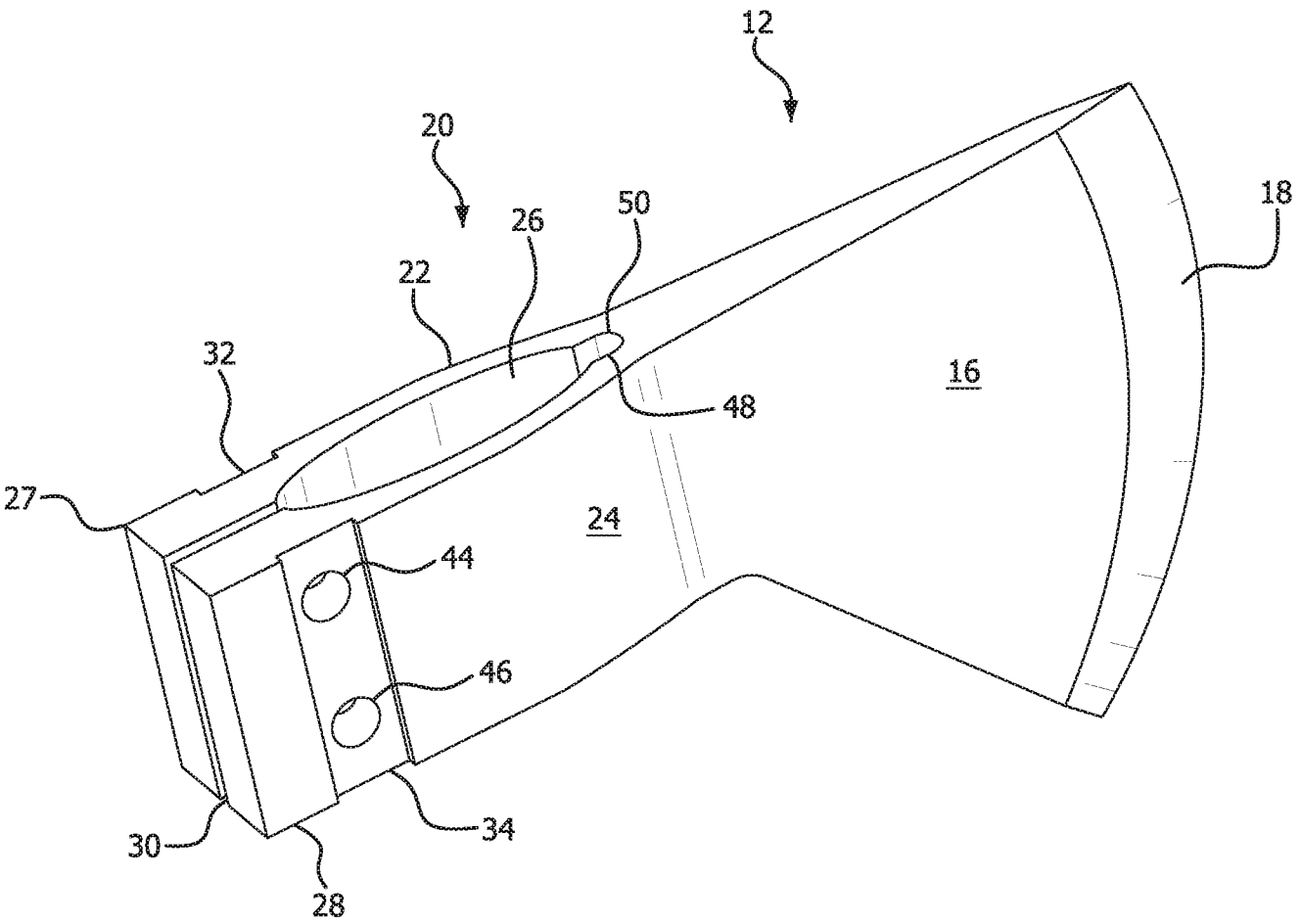
FIG. 3 is a perspective view of an axe head.

Referring to FIGS. 1-7, the axe 10 includes a head 12 and a handle 14. As shown in FIGS. 1-3, the head 12 includes a blade portion 16 having a cutting edge 18 along one end, which may have any of a variety of configurations, depending on the purpose of the axe. The head 12 also includes a handle receiving portion 20 at its other end. The handle receiving portion 20 includes a first flange 22 and flange 24 defining a handle receiving space 26 therebetween. The first flange 22 and second flange 24 each terminate at end 27, 28, defining a narrow channel 30 therebetween. The channel 30 extends from the handle receiving space 26 to the ends 27, 28, being open at both locations. Each of the flanges 22, 24 in the illustrated example also defines a recessed portion 32, 34, respectively. In the illustrated example, each of the recessed portions 32, 34 extends from the top edge 36 to the bottom edge 38 of the axe head 12. At least one aperture is defined within each of the flanges 22, 24 proximate to the ends 27, 28. In the illustrated example, the apertures 40, 42 are defined within the recess 32 of the flange 22, and the apertures 44, 46 are defined within the recess 34 of the flange 24. The apertures 40, 44 are substantially coaxial, being sufficiently coaxial so that a fastener may pass through both apertures. Similarly, the apertures 42, 46 are substantially coaxial, so that a fastener may pass through both apertures. A portion of the apertures 40, 42, 44, 46 overlaps a portion of the handle receiving space 26, with the remaining portion of the apertures 40, 42, 44, 46 overlapping the channel 30. A channel 48 extends from the top edge 36, and terminates within the axe head before reaching the edge 38. In the illustrated example, the channel 48 includes an open top end 50, and a closed bottom end 52 extending a little more than halfway down the forward edge 54 of the handle receiving portion 26. The channel 48 has a width W and a depth D1.

Figure 4:
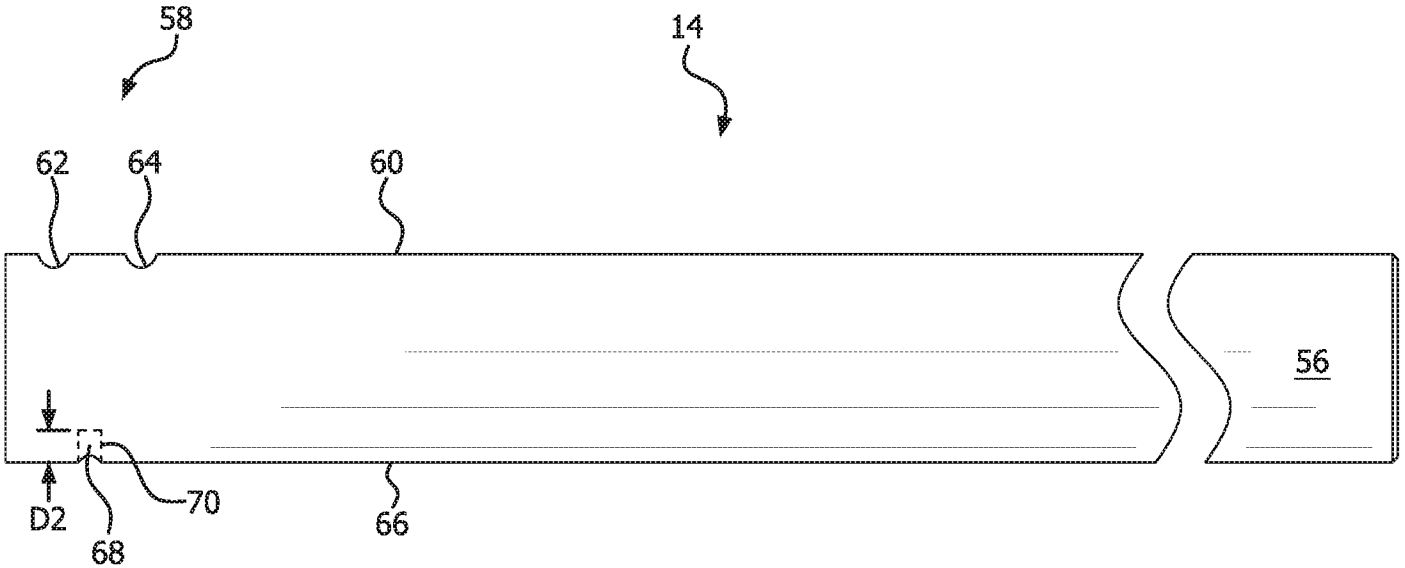
FIG. 4 is a side elevational view of an axe handle.

Referring to FIG. 4, the handle 14 includes a grasping end 56 and the head attachment end 58. The grasping portion 56 may have any configuration that is deemed to provide a comfortable, secure grip for the user. The head attachment end 58 corresponds in size and shape to the handle receiving portion 26, so that the head 12 may be placed around the head receiving portion 58 with little or no movement between the head 12 and handle 14. The back edge 60 of the head receiving portion 58 defines a pair of notches 62, 64, located so that when the head 12 is attached to the handle 14, the notch 62 is substantially aligned with the apertures 40, 44, and the notch 64 is substantially aligned with the apertures 42, 46. The front edge 66 includes a hole 68 that corresponds in width or diameter (W2) to the width of the channel 48. Although the illustrated example of the hole 68 is round, other shapes, including but not limited to square or rectangular, may be used without departing from the invention. The hole 68 has a depth D2, and has a bottom edge 70 that is substantially aligned with the bottom end 52 of the channel 48 when the axe head 12 is attached to the handle 14. Although the illustrated example of the hole 68 is round, other shapes may be used.

Figure 5:
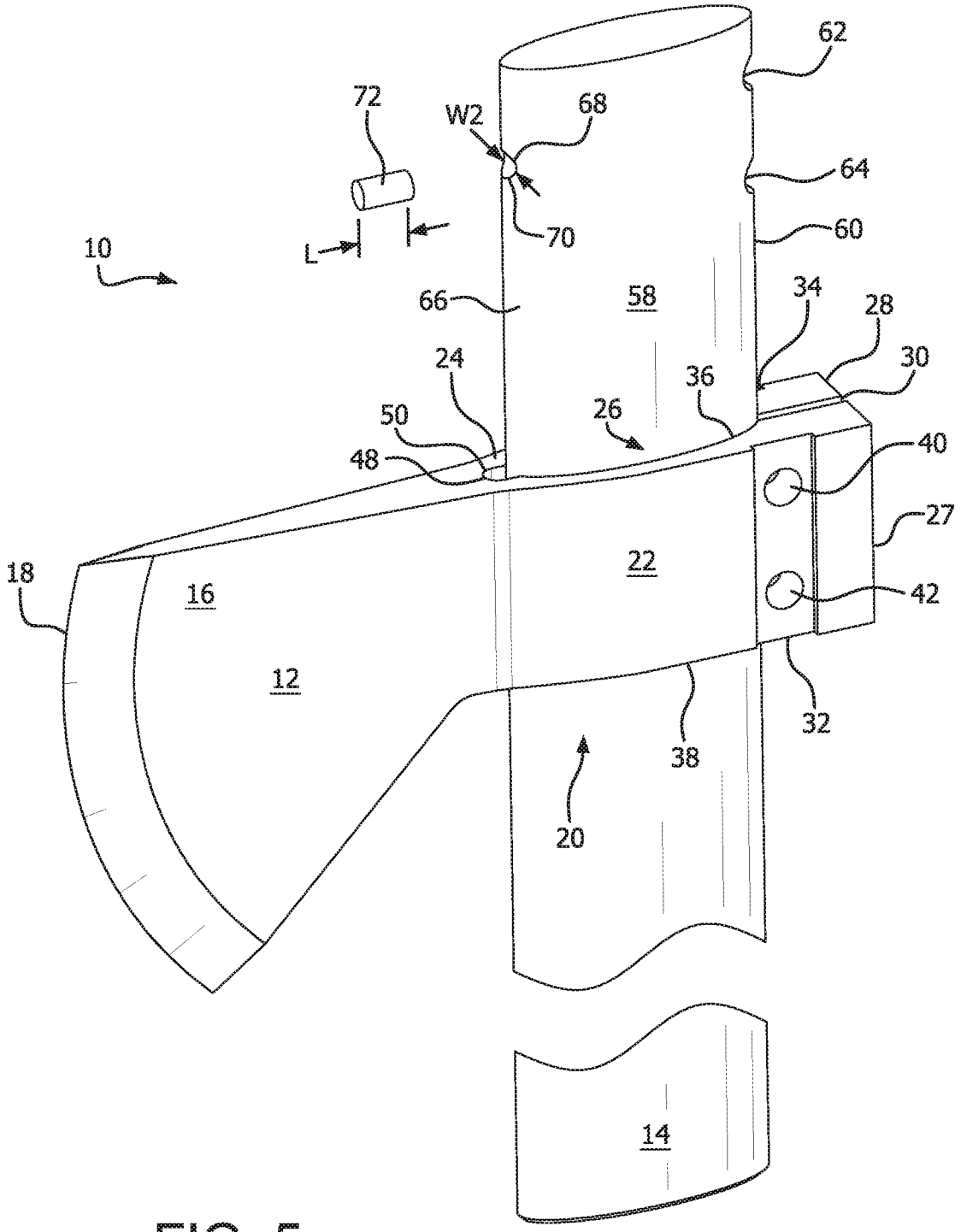
FIG. 5 is a perspective view showing a first step in attaching an axe head to an axe handle.
Figure 6:
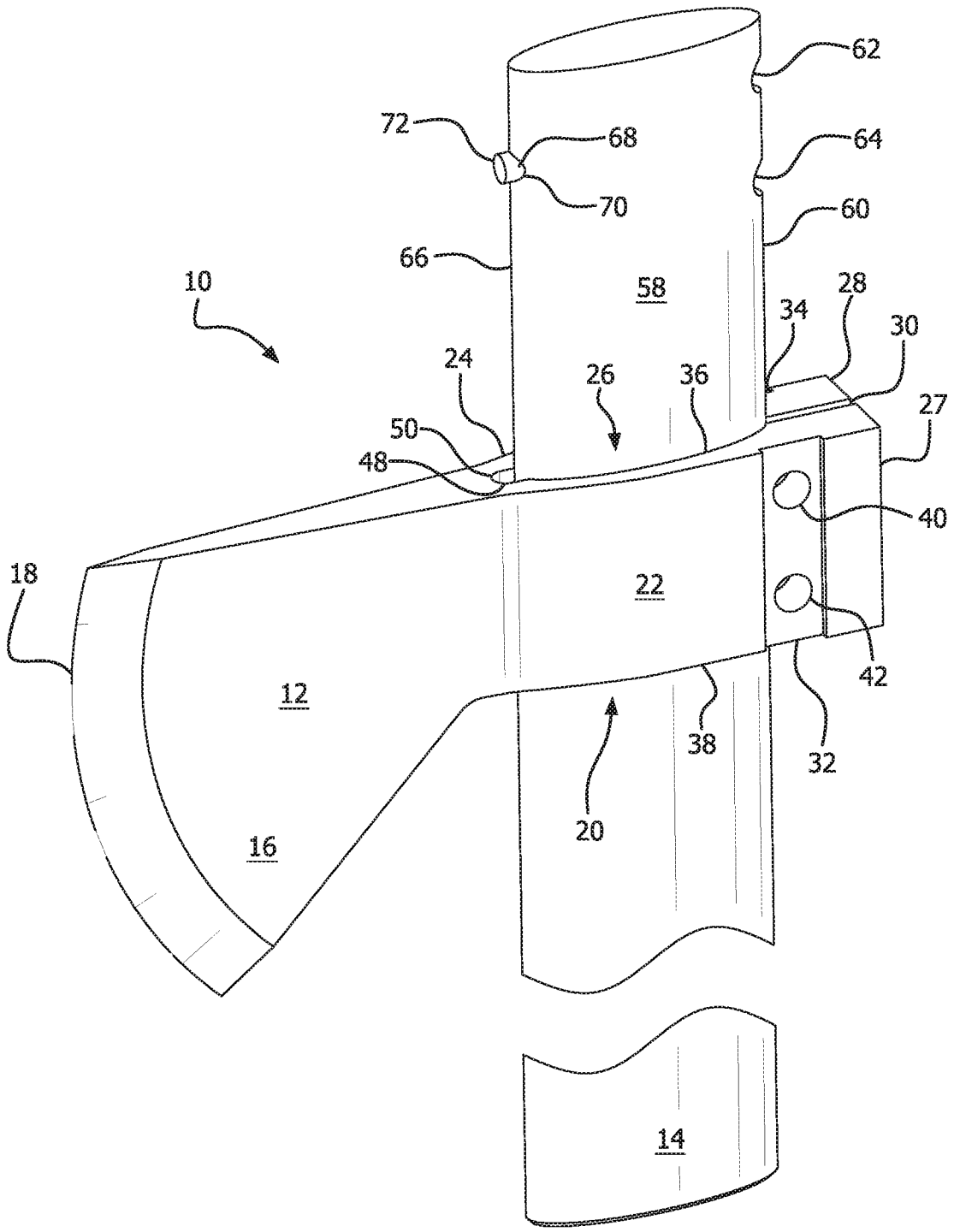
FIG. 6 is a perspective view showing a second step in attaching an axe head to an axe handle.
Figure 7:
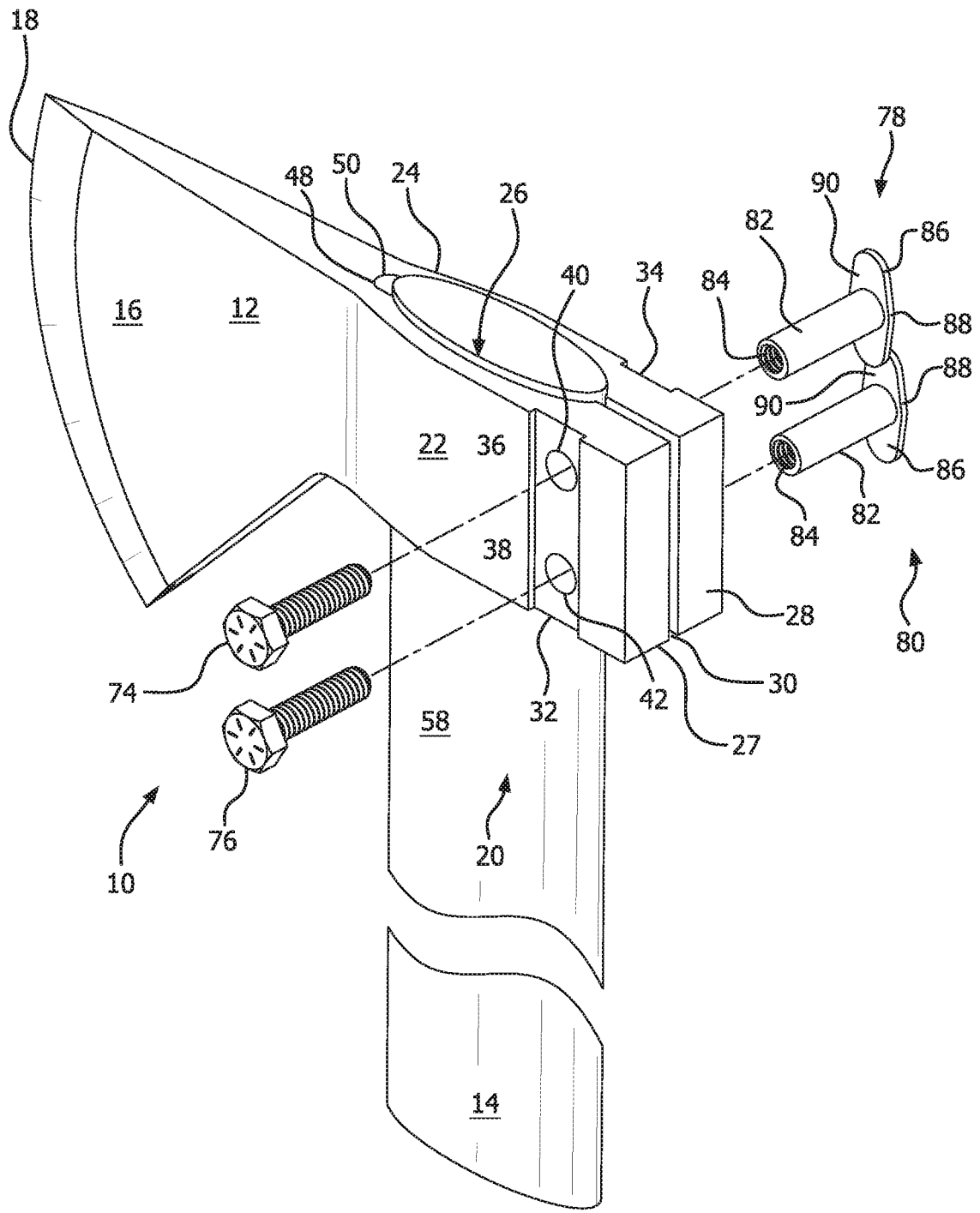
FIG. 7 is a perspective view showing a third step in attaching an axe head to an axe handle.

Referring to FIG. 5, the process of installing the axe head 12 on the handle 14 begins with sliding the head attachment end 58 of the handle 14 into the handle receiving space 26, sliding the head 12 past the notches 62, 64 and hole 68. Next, referring to FIGS. 5-6, a key or pin 72 is placed within the hole 68. Although the illustrated example of the key 72 is a cylindrical pin, other shapes, including but not limited to square or rectangular, may be used without departing from the invention, as long as the key 72 corresponds in size and shape to the hole 68 as described herein. The key 72 substantially corresponds to the shape of the hole 68, having a length L that substantially equals the sum of the depth D of the channel 48 and depth D2 of the hole 68. When the key 72 is fully seated within the hole 68, the key 72 extends outward from the hole 68 for a distance that is substantially equal to the depth of the channel 48. As shown in FIGS. 6-7, the head 12 is then slid back over the head attachment end 58 of the handle 14 until the bottom and 52 of the channel 48 abuts the key 72, resisting further movements of the head 12. At this point, even without additional steps, if the Axe is swung, the inertia of the head 12 will cause the head 12 to push against the key 72, so that the key 72 resists separation of the head 12 from the handle 14.

The opposing flanges are pushed together by a clamping fastener. As used herein, a clamping fastener is any fastener which can be used to bias the flanges 22, 24 together, and can include threaded fasteners such as bolts or screws, cam fasteners, and the like. The illustrated example includes at least one threaded fastener passing through the coaxially aligned holes in the flanges 22, 24. In the illustrated example, a pair of threaded bolts 74, 76 are fastened into T-shaped nuts 78, 80. Each of the T-shaped nuts includes a cylindrical portion 82 defining an internally threaded hole 84 for receiving one of the bolts 74, 76. Each T-shaped nut also includes an elongated, flat base 86 having a pair of edges 88, 90 that abut the sides of a recessed portion 32, 34 to resist rotation of the T-shaped nuts 78, 80. In the illustrated example, the nut 78 passes through the aperture 44 and notch 62. The bolt 74 passes through the aperture 40 and is threadedly secured to the nut 78. Similarly, the nut 80 passes through the aperture 46 and notch 64. The bolt 76 passes through the aperture 42 and is threadedly secured to the nut 80. The flanges 22, 24 are thereby squeezed together around the handle 14. Thus, even without the key 72, the head 12 is secured to the handle 14 by the interaction of the threaded fastener combinations 74, 78 and 76, 80 and the notches 62, 64, as well as by the clamping force applied to the handle 14 by the flanges 22, 24.

Figure 8:
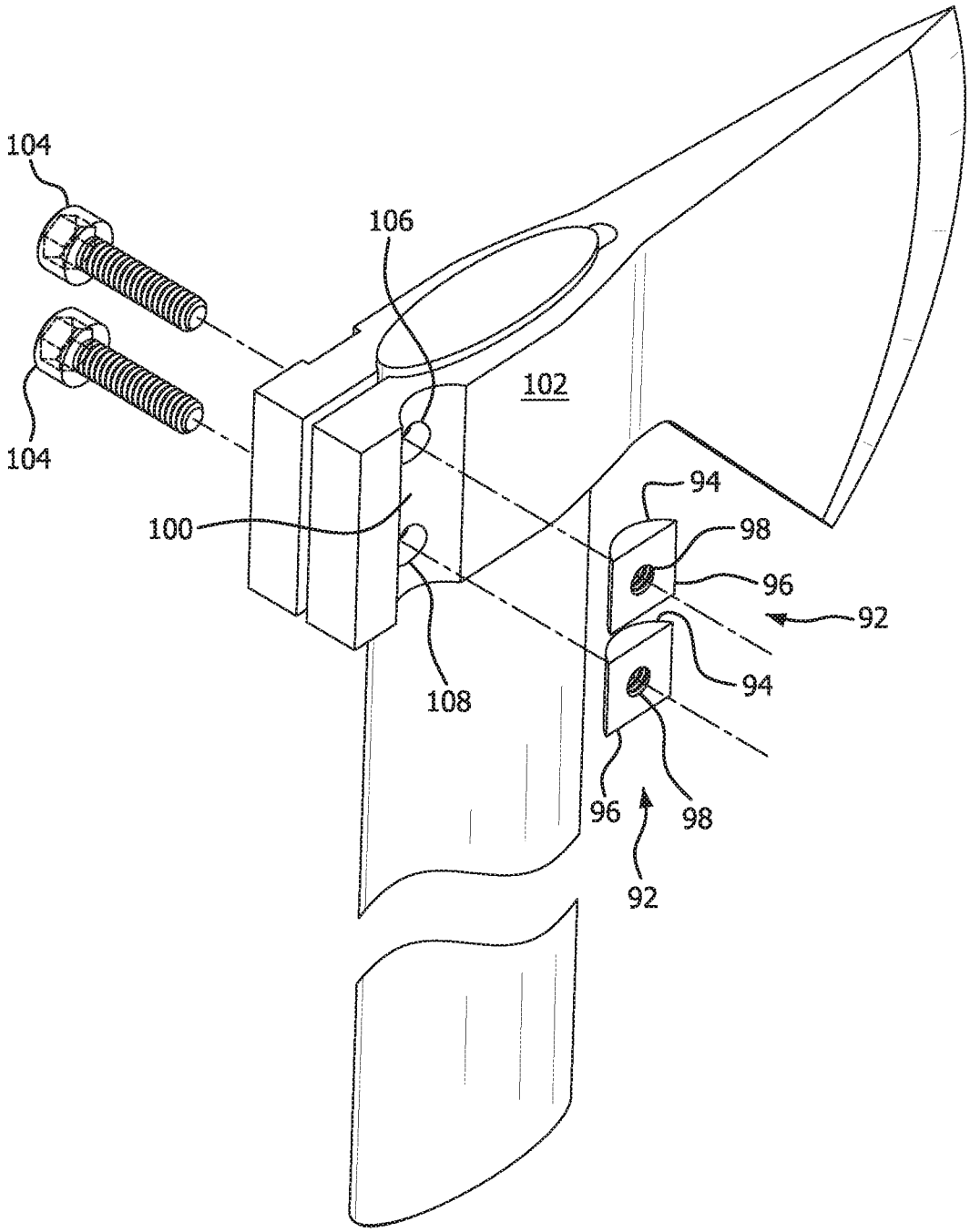
FIG. 8 is a perspective view of another axe head.

As shown in FIG. 8, an alternative style nut is a semi-cylindrical nut 92 having a convex curved surface 94 and a flat surface 96. An internally threaded hole 98 passes from a central position within the flat surface 96 towards a central position in the convex curved surface 94. The recess 100 within the axe head 102 is concave curved, substantially corresponding to the convex curved shape of each nut 92. As before, threaded bolts 104 pass through the holes 106, 108 and the axially aligned holes on the opposing side of the axe head (identical to the holes 44, 46 in FIG. 3) and are threadedly secured within each nut 92. The abutting curved surfaces permit slight movement of the nuts 92 with respect to the recess 100 as the flanges 114, 116 are squeezed together.

Figure 9:
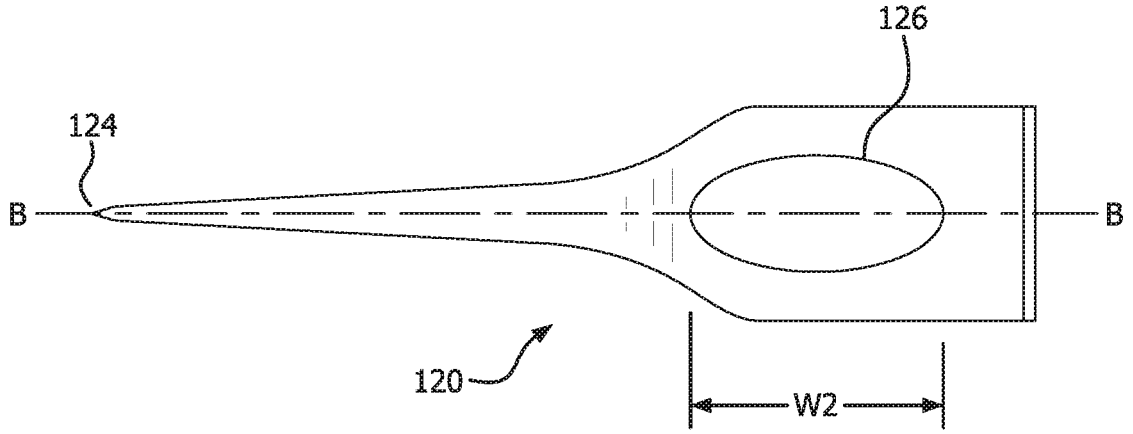
FIG. 9 is a top plan view of another axe head.
Figure 10:
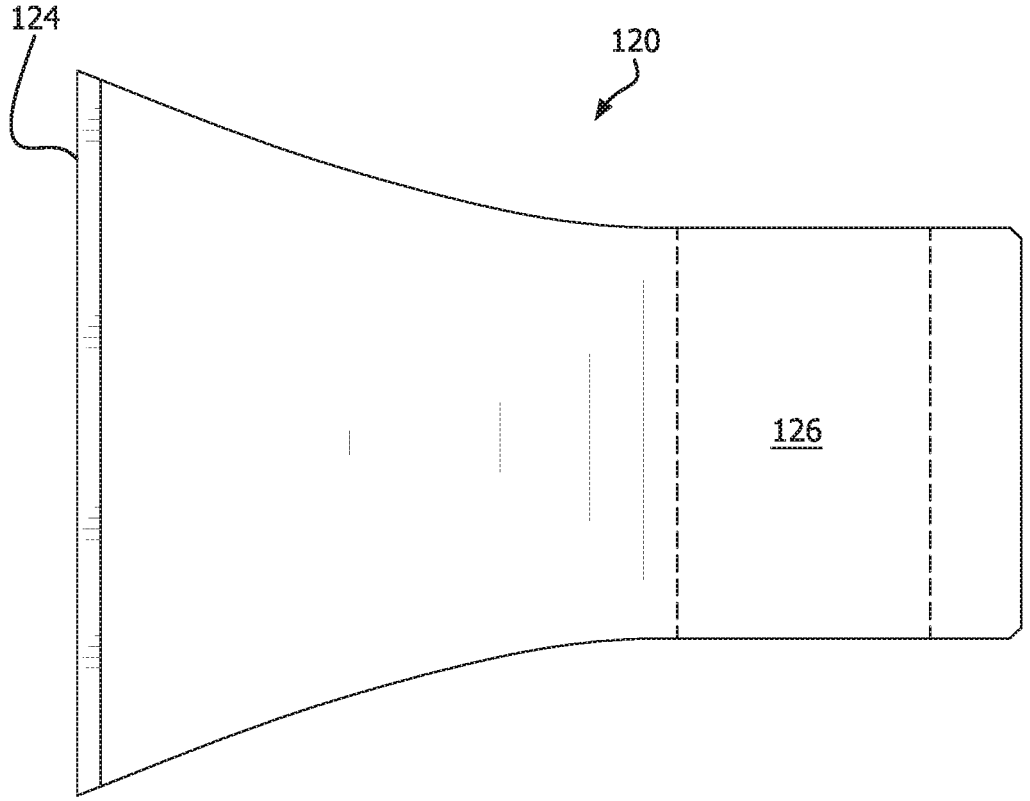
FIG. 10 is a side elevational view of the axe head of FIG. 8.
Figure 11:
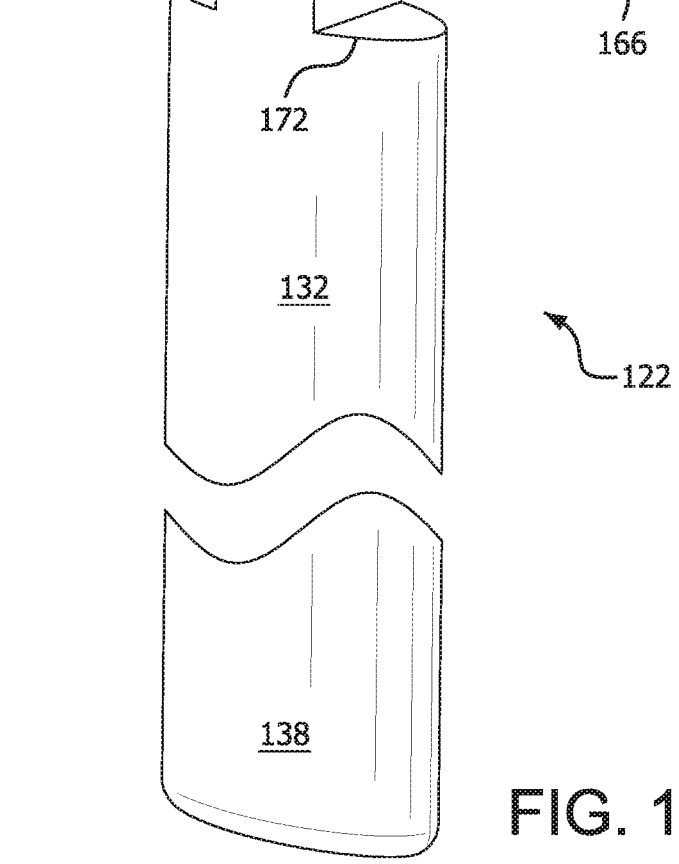
FIG. 11 is a side elevational view of a handle for use with an axe head of FIG. 8.

FIGS. 9-15 illustrate another axe 118 having a head 120 and handle 122. Referring to FIGS. 9-10, the head 120 includes a cutting edge 124 which may have any of a variety of configurations depending on the purpose of the axe 118. The head 120 further includes a hole 126 for receiving a handle. As used herein, the width of the hole 126 is substantially perpendicular to the hole, and substantially perpendicular to the interlocking surface of the shaft (described below). The handle 120, which is shown in FIG. 11, includes a shaft 132 and a pair of end pieces 134, 136. The shaft 132 includes a grasping portion 138 that may have any configuration that is deemed to provide a secure, comfortable grip. The axe head attachment portion 140 includes at least one interlocking surface, and in the illustrated example includes a pair of opposing interlocking surfaces 142, 144 that are spaced more closely together than the diameter of the remainder of the shaft 132. As used herein, an interlocking surface is a surface having at least one feature which, when abutting a corresponding interlocking surface, resists movement in the lengthwise direction of the shaft, such as teeth, pegs, or other projections, and/or holes, grooves, channels, or other recesses for receiving such projections, or any surface textures, substances, or other configurations that provide a high coefficient of friction between the interlocking surfaces. As used herein, the width of the head attachment portion 140 is in a direction substantially perpendicular to at least one interlocking surface. Thus, the width of the head attachment portion 140 of the shaft 132 is less than the width of any portion of the hole 126. Although the illustrated opposing surfaces 142, 144 are disposed facing towards and away from the cutting edge 124, the opposing surfaces 142, 144 may be positioned anywhere around the circumference of the handle. The illustrated example of each of the surfaces 142, 144 includes a plurality of teeth 146, 148, respectively, separated by channels 150, 152, respectively. Although rectangular teeth 146, 148 and rectangular channels 150, 152 are used in the illustrated example, other shapes may be used, for example, square, triangular, trapezoidal, and the like. As another alternative, pegs and corresponding holes could also be used.

Figure 12:
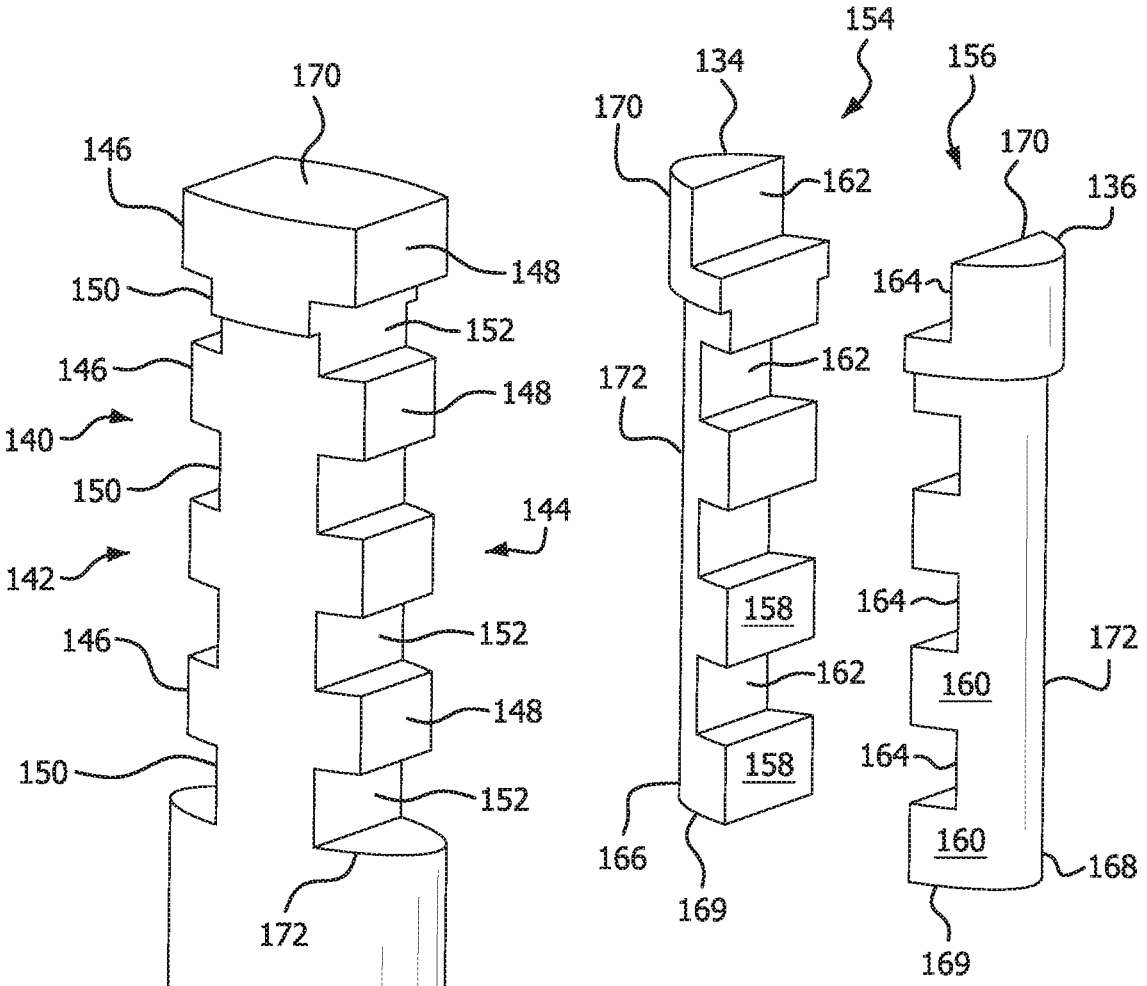
FIG. 12 is a side elevational view of a pair of end pieces for use with a handle of FIG. 10.

Referring to FIG. 12, each of the end pieces 134, 136 includes an interlocking surface 154, 156, respectively, each of which in the illustrated example includes teeth 158, 160, respectively, separated by channels 162, 164, respectively. The teeth 158, 160 are dimensioned and configured to substantially match the channels 150, 152. Similarly, the channels 162, 164 are dimensioned and configured to match the teeth 146, 148. The end pieces 134, 136 may thereby interface with the shaft 132 with sufficiently little play between the shaft 132 and end pieces 134, 136 for comfortable use of the axe 118. The intermediate portion 170 of the end pieces 134, 136 each also include a curved external surface 166, 168, each of which is dimensioned and configured to match the shape of the hole 126, providing for a friction fit when joined to the shaft 132 as described below. The end pieces 134, 136 also include an enlarged top portion 172 which will not fit into the hole 126 when the end pieces 134, 136 are joined to the shaft 132.

Figure 13:
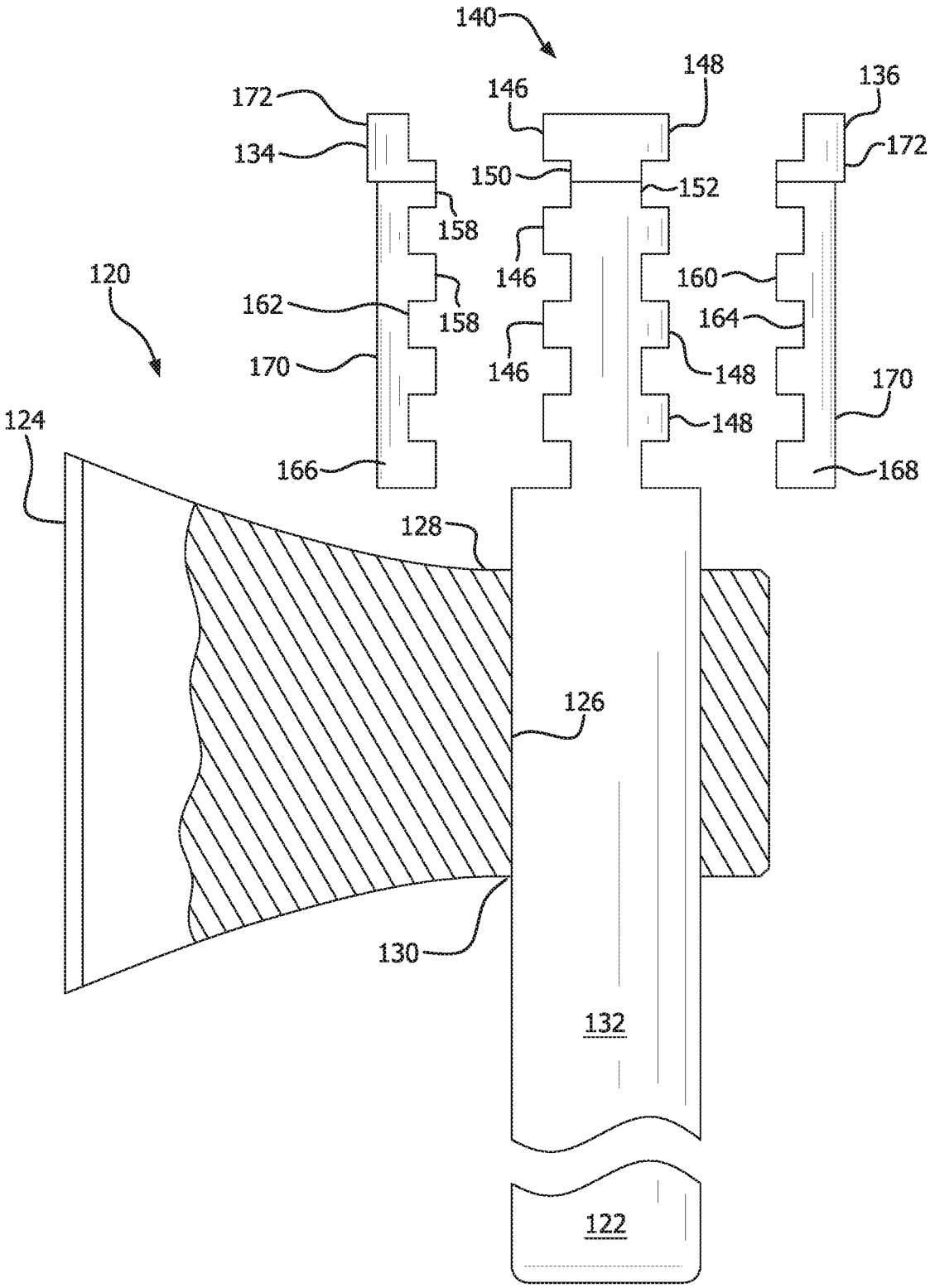
FIG. 13 is a partially cross sectional view of the axe head of FIG. 8 showing a first step of attaching a handle, taken along the lines B-B in FIG. 8.
Figure 14:
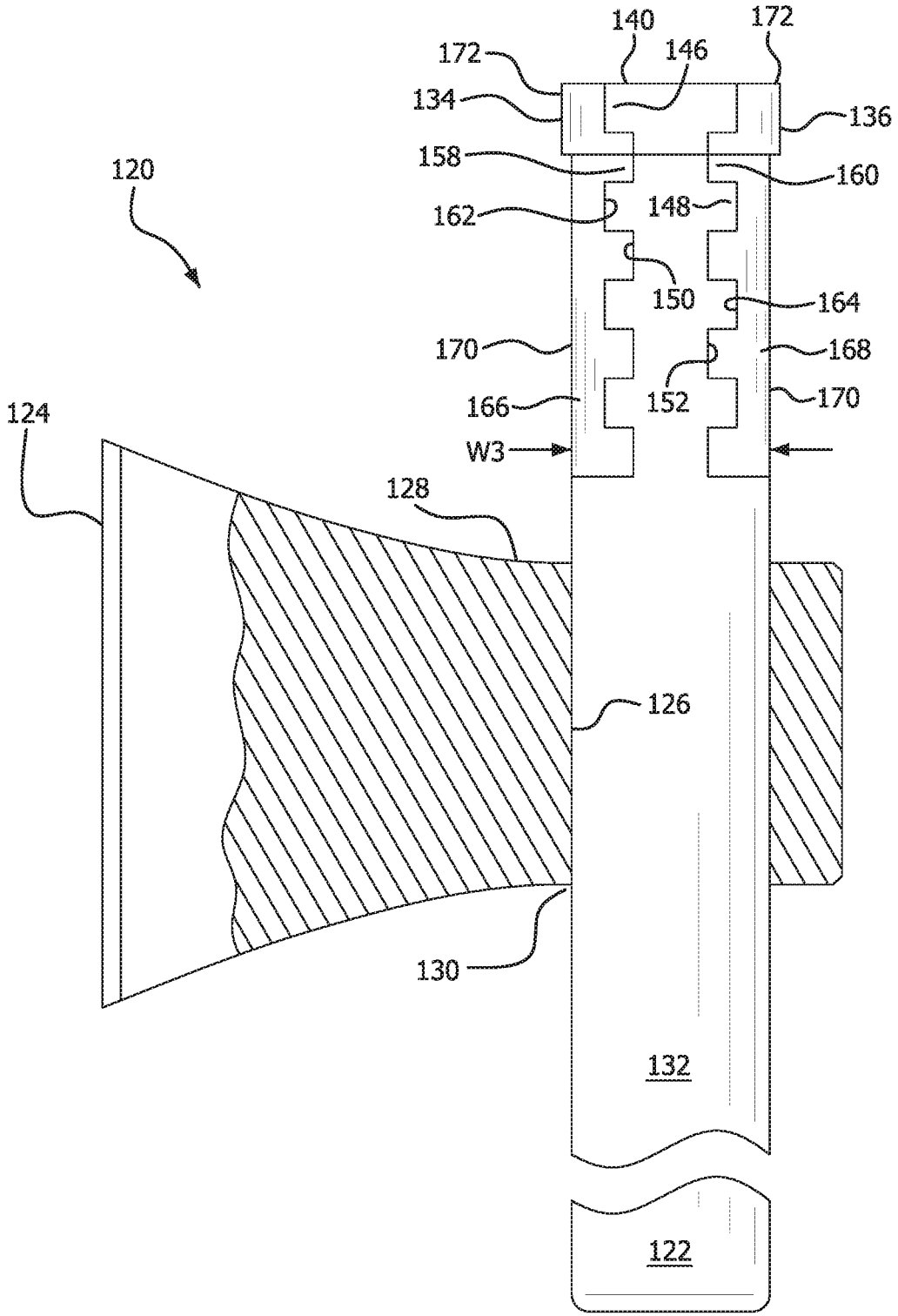
FIG. 14 is a partially cross sectional view of the axe head of FIG. 8 showing a second step of attaching a handle.
Figure 15:
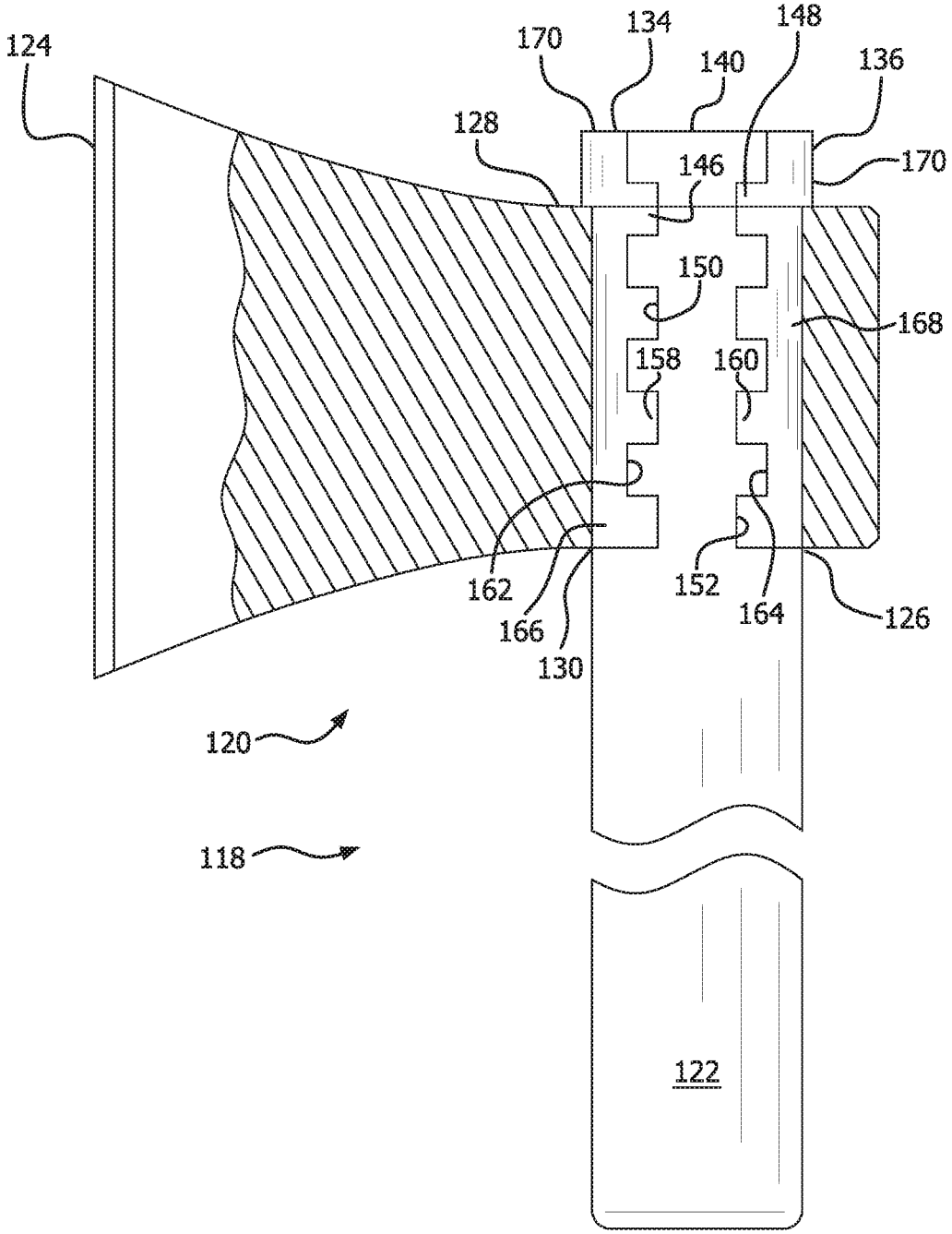
FIG. 15 is a partially cross sectional view of the axe head of FIG. 8 showing the handle fully attached.

Referring to FIGS. 13-15, to attach the axe head 120 to the handle 122, the axe head is first slid onto the shaft 132 to a position below the surfaces 142, 144, as shown in FIG. 12.

The end pieces 134, 136 are joined to the surfaces 142, 144, as shown in FIG. 13. The axe head is then slid over the end pieces 134, 136, so that the hole 126 contains the shaft 132 as well as the end pieces 134, 136, as shown in FIG. 14. The shape of the assembly of the shaft 132 and end pieces 134, 136 retains the axe head 120 on the handle 122, and the inertia of the axe head 120 is countered by the top 172 of the end pieces 134, 136 as the axe is swung. The head 120 can be removed by sliding the head downward off of the end pieces 134, 136, removing the end pieces 134, 136 from the shaft 132, and then sliding the head 120 off of the shaft 132.

The axe heads 12, 102, 120 are preferably made from a high carbon steel that is tempered to a hardness that permits some elastic deflection of the material, which not only facilitates absorbing impacts as the axe is used as a tool, but which also provide sufficient flexibility for clamping of the axe heads 12, 102 around the handle. Example of such a steel include 1055, 1095, and SK-5. A preferred hardness is about 50 to about 55 on the Rockwell scale. Some examples may include cutting edges that are hardened to a higher level of hardness than the body of the head, providing edge holding ability to the edge and impact resistance to the softer body. Possible handle materials include any suitable wood, with examples including but not limited to hickory, ash, and oak. The handle could also be made from metal, or from any sufficiently rigid polymer. Examples of suitable polymers include fiberglass, polypropylene, nylon, and composites of nylon and fiberglass. The end pieces 134, 136 can be made from polypropylene or glass filled nylon.

The axe therefore provides an easy, secure method of attaching the axe head to the handle. The attachment does not limit the shape of the grasping portion of the handle. The inertia of the axe as it is being swung contributes to the retention of the head on the handle, with the inertia causing the head to bear against a structure on the handle that resists separation of the head from the handle. Although one variation of the axe utilizes threaded fasteners to secure the axe head to the handle, separation of the axe head from the handle is resisted even if the threaded fasteners become loosened. If at least one end piece 134, 136 is included, then the end piece 134, 136 may also provide some shock absorption, increasing the comfort of using the axe.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. An axe, comprising:

a head having a top surface, a bottom surface, and an opening extending from the top surface to the bottom surface, the opening having a wall defining a channel therein, the channel having a closed end located at an intermediate portion of the opening and an open end opposite the closed end, the open end being located at to the top surface of the opening, the channel having a width and a depth;

a handle having a head attachment portion fitting within the opening and a grasping end opposite the head attachment portion, the head attachment portion having a hole, the hole being substantially aligned with the closed end of the channel, the hole having a width or a diameter that is substantially identical to the width of the channel, the hole further having a depth; and a key disposed within the hole and within the closed end of the channel, the key having a length that is substantially equal to the sum of the depth of the hole and the depth of the channel, the key further having a width or a diameter that is substantially identical to the width or diameter of the hole;

whereby the key resists movement of the head away from the grasping end of the handle when the key is within the hole and the head is on the head attachment portion of the handle and permits movement of the head towards the grasping end of the handle.

2. An axe, comprising:

a head having a top surface, a bottom surface, and an opening extending from the top surface to the bottom surface, the opening having a wall defining a channel therein, the channel having a closed end located at an intermediate portion of the opening and an open end opposite the closed end, the open end being located at the top surface of the opening, the channel having a width and a depth, the head including a body having a cutting edge and a pair of flanges extending opposite the cutting edge, the flanges being disposed on opposing sides of the opening, each of the flanges defining at least one fastener hole disposed opposite the body;

a handle having a head attachment portion fitting within the opening and a grasping end opposite the head attachment portion, the head attachment portion having a hole, the hole being substantially aligned with the closed end of the channel, the hole having a width or a diameter that is substantially identical to the width of the channel, the hole further having a depth;

a key disposed within the hole and within the closed end of the channel, the key having a length that is substantially equal to the sur of the depth of the hole and the depth of the channel, the key further having a width or a diameter that is substantially identical to the width or diameter of the hole; and a clamping fastener passing through the fastener holes;

whereby the key resists movement of the head away from the grasping end of the handle when the key is within the hole and the head is on the head attachment portion of the handle and permits movement of the head towards the grasping end of the handle.

3. The axe according to claim 2, wherein:

the handle defines a channel therein, the channel being substantially aligned with the fastener holes; and the clamping fastener passes through the channel defined in the handle when the head is fastened to the handle.

4. The axe according to claim 2, wherein the clamping fastener includes a nut having an inwardly facing convex curved surface abutting a corresponding outwardly facing concave curved surface defined on one flange, and a threaded fastener passing through the fastener hole of the other flange and engaging corresponding threads defined within the nut.

* * * * *